US009022924B1

(12) United States Patent
Thrasher

(10) Patent No.: US 9,022,924 B1
(45) Date of Patent: May 5, 2015

(54) HAND-HELD PLATFORM FOR A PHALLIC DEVICE

(76) Inventor: Dwight L. Thrasher, Eutaw, AL (US)

( * ) Notice: Subject to any disclaimer, the term of this patent is extended or adjusted under 35 U.S.C. 154(b) by 502 days.

(21) Appl. No.: 13/329,925

(22) Filed: Dec. 19, 2011

(51) Int. Cl.
*A61H 19/00* (2006.01)

(52) U.S. Cl.
CPC ..... *A61H 19/44* (2013.01)

(58) Field of Classification Search
CPC ..... A61H 19/44; A61H 2201/0153; A61H 19/32; A61H 19/00; A61H 2201/165; A61H 19/30; A61H 19/40; A61H 19/50; A61H 2201/1685
USPC ..... 600/38; 128/845
See application file for complete search history.

(56) References Cited

U.S. PATENT DOCUMENTS

| | | | | |
|---|---|---|---|---|
| 4,722,327 | A | 2/1988 | Harvey | |
| 5,127,396 | A | 7/1992 | McAllister | |
| 5,690,604 | A | 11/1997 | Barnett | |
| 5,704,894 | A | 1/1998 | Boutos | |
| 5,725,473 | A | 3/1998 | Taylor | |
| 5,851,175 | A | 12/1998 | Nickell | |
| 5,853,362 | A | 12/1998 | Jacobs | |
| 6,203,491 | B1 | 3/2001 | Uribe | |
| 6,540,667 | B2 | 4/2003 | Hickman | |
| 6,547,717 | B1 | 4/2003 | Green et al. | |
| 6,749,558 | B1 | 6/2004 | Brintle | |
| 6,991,599 | B2 | 1/2006 | Hudson | |
| 7,056,281 | B2 | 6/2006 | Bookwalter et al. | |
| 7,201,170 | B2 | 4/2007 | Espinosa | |
| 7,390,295 | B2 | 6/2008 | Hatami | |
| 7,513,868 | B1 | 4/2009 | Fontenot | |
| 7,524,283 | B1 | 4/2009 | Johnstone, II | |
| D633,216 | S | 2/2011 | Stevens | |
| 2006/0004251 | A1 | 1/2006 | Bookwalter et al. | |
| 2009/0131744 | A1 | 5/2009 | Pattenden | |
| 2011/0009691 | A1* | 1/2011 | Stevens | 600/38 |
| 2011/0082333 | A1 | 4/2011 | Wilson et al. | |

* cited by examiner

*Primary Examiner* — Christine H Matthews

(57) ABSTRACT

A hand-held sex aid comprising a platform with handles and with a ring positioned in a central area on a top side of the platform. Straps are attached to the ring and extend through slots to the bottom side of said platform, wherein the straps connect to each other to force the ring against a base of a phallic device, thereby securing the phallic device on the top side. A self-user can grasp the handles and position the platform in front or in back of the self-user and insert the phallic device into a body cavity. A first partner can grasp the handles and position the platform in front or in back of a second partner and insert the phallic device into a body cavity of the second partner. The phallic device can be manipulated as desired by using the handles.

8 Claims, 4 Drawing Sheets

HAND-HELD PLATFORM FOR A PHALLIC DEVICE

FIELD OF THE INVENTION

This invention relates generally to a sex aid and, more particularly, to a manually manipulated platform with handles and supporting a phallic device, which can be used by an individual, or an individual with a partner, for vaginal or anal penetration.

BACKGROUND OF THE INVENTION

Various types of sexual aids for use in sexual stimulation have been in use throughout history. Many mechanical and manual manipulative devices have been invented having a variety of shapes for both vaginal and anal penetration. Some of these devices, also called dildos, are designed to simulate the male sexual organ in a manner so as to increase sexual stimulation through known methods. These devices are used by both men and women alone or as couples. In many instances, some women have no partners and do not wish to subject themselves to potential harm from strangers who may be disease carriers.

Conventional therapeutic devices currently available include various types of vibrators and automated mechanical sex aids. Many of these sex aids require the use of another partner, either male or female. Such aids also include electro-mechanical reciprocating devices that are mounted stationary using springs or elastic harnesses and the like. Such devices generally require unnatural positioning and are awkward to use. Although there are a large number of sexual devices that closely resemble the male sex organ (phallic devices), they have been found to be heavy, expensive, and require a great deal of awkward manipulation and imagination to achieve any significant gratification. What is needed is a simple light-weight device that allows a user to perform vaginal or anal penetration easily by himself or herself, or to allow one partner to perform anal or vaginal penetration with the device on a second partner, or to allow both partners to perform anal or vaginal penetration with the devices on each other.

SUMMARY OF THE INVENTION

The present invention is a hand-held sex aid having a platform with a top side, a bottom side, a first end, and a second opposite end. A handle is positioned near the first end and near the second opposite end. There is a ring positioned in a central area on the top side of the platform. There are slots in the platform that extend from the top side to the bottom side. One or more pairs of straps are attached to the ring at one end of the straps, while the opposite end of the straps extend through the slots to the bottom side of the platform. The straps in a given pair are reversibly connected to each other on the bottom side of the platform to force the ring against a base of a phallic device, thereby securing the phallic device reversibly in place on the top side. When in place the phallic device extends away from the top side of the platform, preferably perpendicularly.

A self-user of the platform grasps the handles and positions the platform in front or in back of the self-user. The self-user then inserts the phallic device into a body cavity and manipulates the phallic device as desired, or holds the phallic device in place, using the handles. The platform can also be used with a partner. A first partner grasps the handles and positions the platform in front or in back of a second partner. The first partner inserts the phallic device into a body cavity of the second partner. The first partner then manipulates the phallic device, or holds the phallic device in place, using the handles.

An advantage of the present invention is a sex aid that can be used safely by a person of any size.

Another advantage is a sex aid that can be used from the front or back of a self-user.

Another advantage is a sex aid that can be used in any position, including standing, sitting, squatting, kneeling, or laying down.

Another advantage is a sex aid that can be used with one or more partners.

Another advantage is a sex aid that can utilize any desired size and shape phallic device which is secured reversibly to the top side of the platform with a ring and strap assembly.

DETAILED DESCRIPTION OF THE INVENTION

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
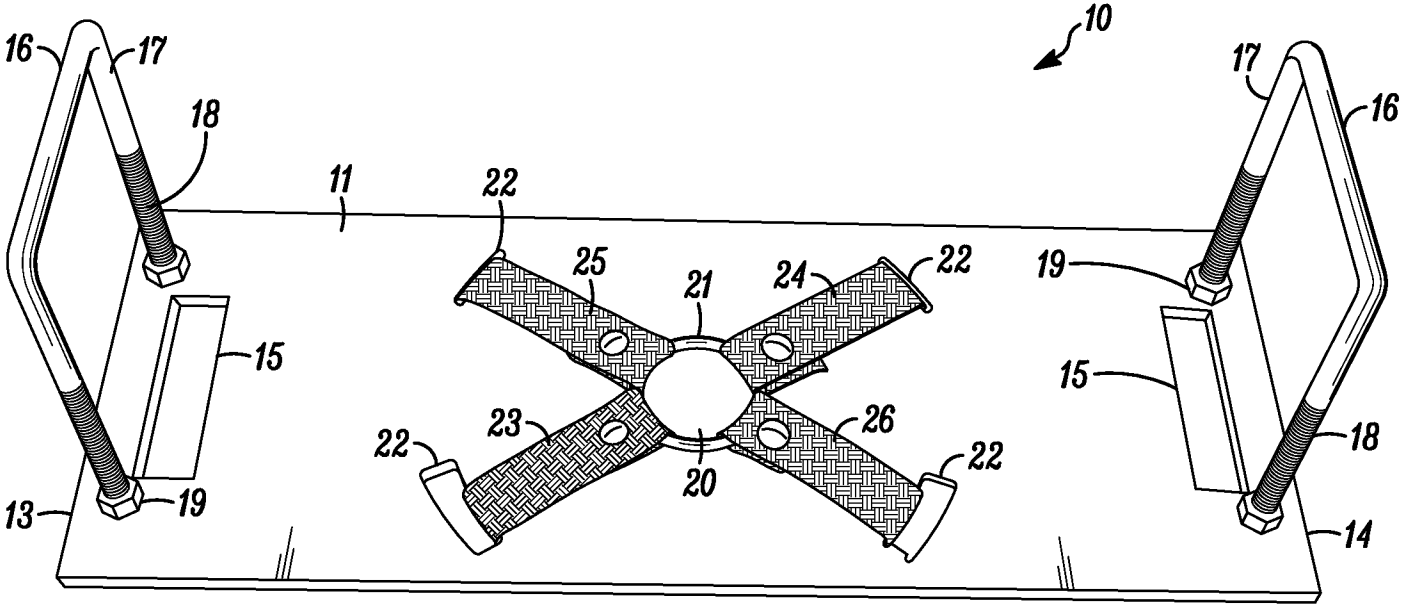
FIG. 1 shows a top perspective view of the hand-held platform of the present invention.

FIG. 1 shows an illustration of the platform 10 of the present invention. Platform 10 has a top side 11, and bottom side 12, a first end 13, and a second opposite end 14. Handles 15 may be cut into the platform near the ends 13 and 14. Alternatively, or in addition, U-shaped handles 16 may be positioned near the ends 13 and 14. The U-shaped handles 16 have legs 17 which extend away from the top end 11, preferably perpendicularly. The legs 17 can also extend through the platform 10 to the bottom side 12. The legs can have threads 18 so that nuts 19 can secure the legs 18 to the platform 10 from both the top side and bottom side (see FIG. 2). The height to which the U-shaped handles 16 extend up from the platform 10 can be adjusted by adjusting the nuts 19 on the top side and the bottom side of platform 10.

Figure 2:
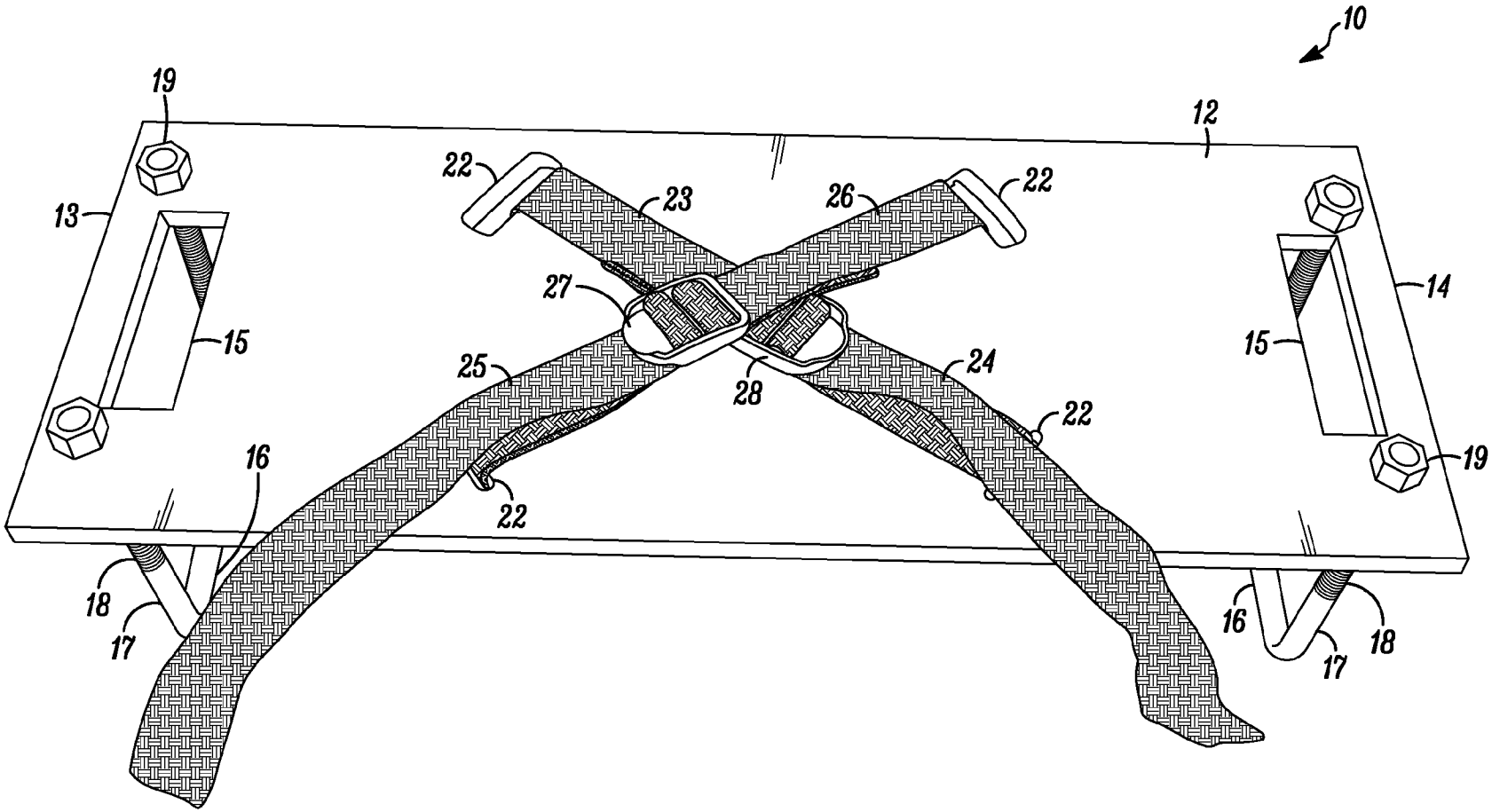
FIG. 2 shows a bottom perspective view of the hand-held platform.

Platform 10 has slots 22 which extend through platform 10 from the top side 11 to the bottom side 12. A ring 21 having an interior 20 is positioned in a central area of the platform 10. Straps 23, 24, 25, and 26 are attached to the ring 21 at one end of the straps. The opposite end of the straps extend through the slots 22 to the bottom side 12 of the platform 10. Straps 23 and 24 form one pair of straps. Straps 25 and 26 form a second pair of straps. The straps in a given pair are reversibly connected to each other on the bottom side 12 of the platform 10. As shown in FIG. 2 the opposite end of strap 23 is connected to a buckle 28 and the opposite end of strap 24 is looped through buckle 28. Likewise, the opposite end of strap 26 is connected to buckle 27 and the opposite end of strap 25 is looped through buckle 27. By pulling on the loose opposite ends of straps 24 and 25 the straps will pull on ring 21 and reversibly tighten it against the top side 11 of platform 10. If a phallic device 30 is positioned within the ring 21 (see FIG. 3), tightening the straps will secure the phallic device 30 reversibly in place on the top side 11. The phallic device 30 will extend away from the top side 11, preferably perpendicular to top side 11.

Figure 3:
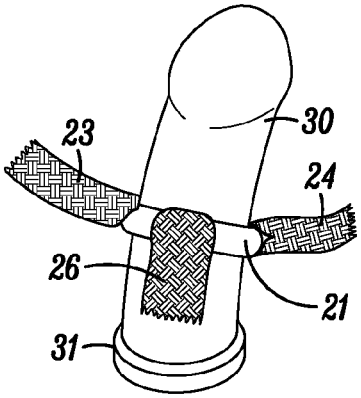
FIG. 3 shows the positioning of a phallic device within a ring wherein the ring secures the phallic device reversibly to the top side of the platform by means of a strap assembly.

FIG. 3 illustrates a phallic device 30 positioned within the interior 20 of ring 21. The phallic device should have a base 31 which has a diameter greater than the diameter of ring 21. As the straps 24 and 25 are pulled tight through buckles 27 and 28 the ring 21 will compress the base 31 against the top side 11 securing the phallic device 30 in place on top side 11. A phallic device includes any kind of dildo or any conical shaped device suitable for insertion into the vagina or anus. Any kind of suitable connectors can be used besides buckles 27 and 28, for example, hook and pile arrangements. The platform 10 can be constructed of any kind of plastic, metal, or wood, or any combination thereof. The U-shaped handles 16 can be made of any kind of plastic or metal or a combination thereof. The straps 23, 24, 25, and 26 can be made of any type of plastic or cloth or related materials.

Figure 4:
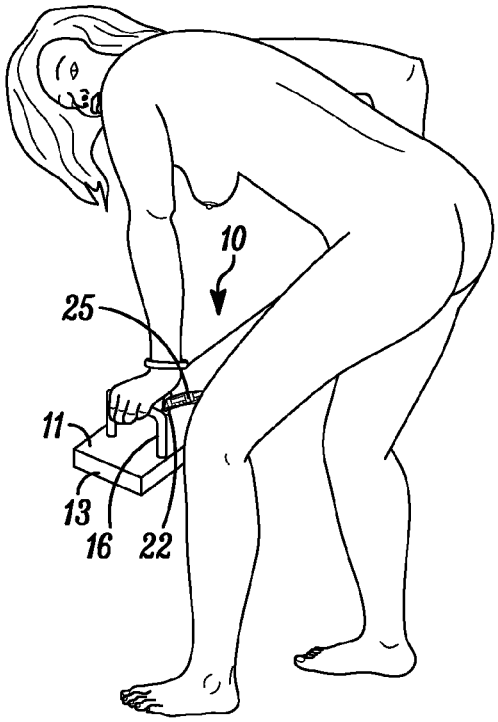
FIG. 4 shows an illustration of the use of the platform positioned in front of a user.
Figure 5:
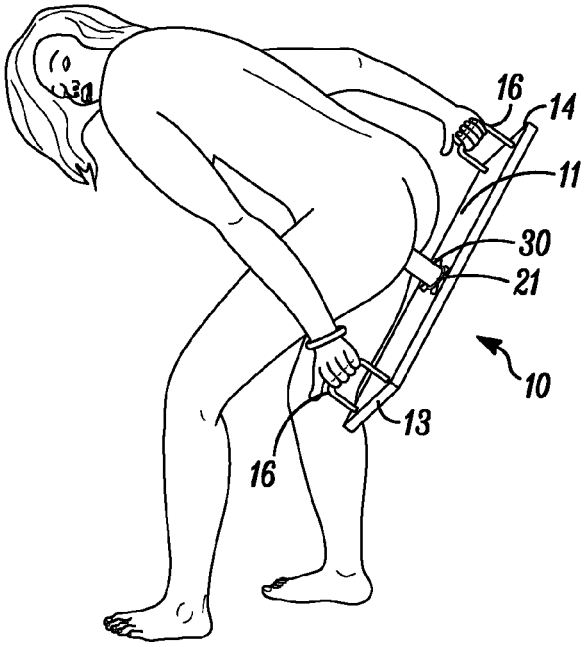
FIG. 5 shows an illustration of the use of the platform positioned in back of a user.

FIG. 4 illustrates a self-user grasping the handles 16 of platform 10 and positioning the platform 10 in front of the self-user. The phallic device 30 on the platform 10 can be inserted into a body cavity, the vagina in this case, and the phallic device 10 can be manipulated or held in position therein using the handles 16 of platform 10. FIG. 5 illustrates a self-user of platform 10 grasping the handles 16 and positioning the platform 10 in back of the self-user. The phallic device 30 on the platform 10 can be inserted into a body cavity, the vagina or anus in this case, and the phallic device 10 can be manipulated or held in position therein using the handles 16. A self user can be a man or a woman.

Figure 6:
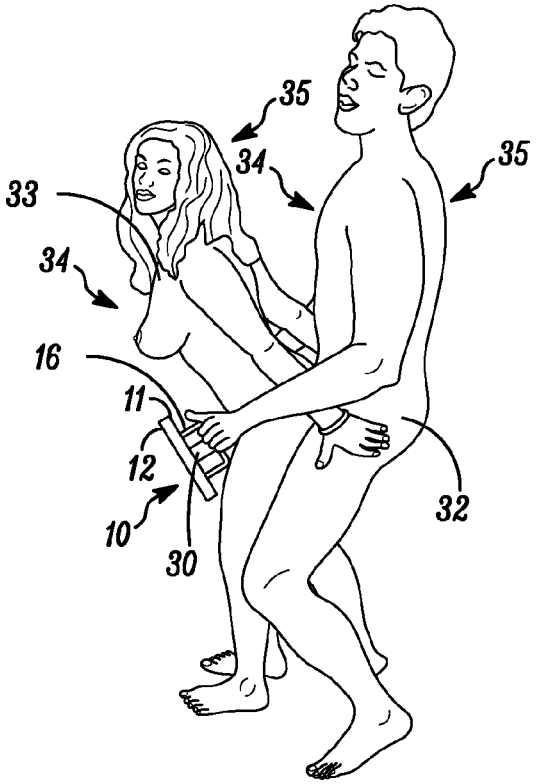
FIG. 6 shows an illustration of the use of the platform positioned by a first partner in front of a second partner.
Figure 7:
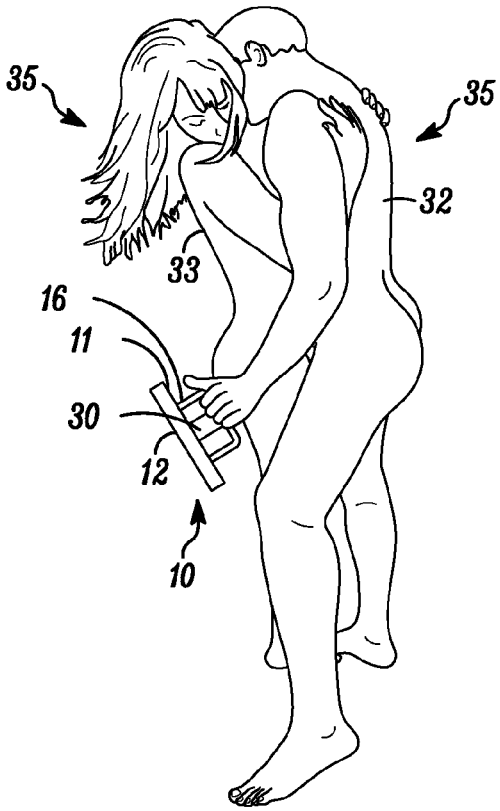
FIG. 7 shows an illustration of the use of the platform positioned by a first partner in back of a second partner.

FIG. 6 illustrates a first partner 32 grasping the handles 16 and positioning the platform 10 in front 34 of a second partner 33. The phallic device 30 on platform 10 can be inserted into a body cavity, the vagina in this case, and the phallic device 30 can be manipulated or held in position therein using the handles 16. FIG. 7 illustrates a first partner 32 grasping the handles 16 and positioning the platform 10 in back 35 of a second partner 33. The phallic device 30 on platform 10 can be inserted into a body cavity, the vagina or anus in this case, and the phallic device 30 can be manipulated or held in position therein using the handles 16. The first partner can be a man or a woman. The second partner can be a man or a woman. Although the illustrations in FIGS. 4-7 show the self user or partners 32, 33 in a standing position, the platform 10 can be used in any other desired position, such as, for example, sitting, squatting, kneeling, reclining, or lying down.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A hand-held sex aid, comprising:

a) a rigid planar platform having a top side, a bottom side, a first end, and a second opposite end;

b) a rigid U-shaped first handle mounted adjacent said first end of said platform, said first handle extending perpendicularly from said top side of said platform;

c) a rigid U-shaped second handle mounted adjacent said second end of said platform, said second handle extending perpendicularly from said top side of said platform;

d) a phallic device having a base, said phallic device extending perpendicularly from a central area of said top side of said platform;

e) a ring positioned around said phallic device on said top side of said platform, wherein said ring is operable to engage said base of said phallic device;

f) a plurality of slots through said platform, said plurality of slots located circumferentially around said phallic device; and g) a plurality of straps attached to said ring and extending through said plurality of slots, wherein said plurality of straps are operable to reversibly secure said ring and said phallic device to said top side of said platform.

2. A hand-held sex aid according to claim 1, wherein said first handle and said second handle are adjustable in height.

3. A hand-held sex aid according to claim 1, further comprising a third handle formed as an elongated aperture through said platform adjacent said first end of said platform.

4. A hand-held sex aid according to claim 3, further comprising a fourth handle formed as an elongated aperture through said platform adjacent said second end of said platform.

5. A method for manipulating a phallic device, comprising the steps of:

1) providing a hand-held sex aid, comprising:

a) a rigid planar platform having a top side, a bottom side, a first end, and a second opposite end;

b) a rigid U-shaped first handle mounted adjacent said first end of said platform, said first handle extending perpendicularly from said top side of said platform;

c) a rigid U-shaped second handle mounted adjacent said second end of said platform, said second handle extending perpendicularly from said top side of said platform;

d) a phallic device having a base, said phallic device extending perpendicularly from a central area of said top side of said platform;

e) a ring positioned around said phallic device on said top side of said platform, wherein said ring is operable to engage said base of said phallic device;

f) a plurality of slots through said platform, said plurality of slots located circumferentially around said phallic device; and g) a plurality of straps attached to said ring and extending through said plurality of slots, wherein said plurality of straps are operable to reversibly secure said ring and said phallic device to said top side of said platform;

2) grasping said first handle and said second handle;

3) inserting said phallic device into a body cavity using said first handle and said second handle; and 4) manipulating said phallic device within the body cavity using said first handle and said second handle.

6. A method according to claim 5, wherein said first handle and said second handle are adjustable in height.

7. A method according to claim 5, further comprising a third handle formed as an elongated aperture through said platform adjacent said first end of said platform.

8. A method according to claim 7, further comprising a fourth handle formed as an elongated aperture through said platform adjacent said second end of said platform.

* * * * *